US005575392A

United States Patent [19]

Cutler

[11] Patent Number: 5,575,392

[45] **Date of Patent: *Nov. 19, 1996**

[54] PILL DISPENSER

[76] Inventor: Paul A. Cutler, 14 Kirkham Drive, Ajax, Ontario, Canada, L1S 5K5

[ * ] Notice: The portion of the term of this patent subsequent to Jan. 22, 2011, has been disclaimed.

[21] Appl. No.: 308,478

[22] Filed: Sep. 19, 1994

Related U.S. Application Data

[60] Continuation of Ser. No. 856,784, Mar. 24, 1992, abandoned, which is a division of Ser. No. 644,406, Jan. 22, 1991, Pat. No. 5,154,296, which is a continuation of Ser. No. 357,579, May 26, 1989, abandoned.

[51] Int. Cl.[6] ..... B65D 83/04

[52] U.S. Cl. ..... 206/534; 206/533; 206/536; 206/538; 221/4; 221/91

[58] Field of Search ..... 206/533, 534, 206/536, 538, 539, 459; 221/4, 5, 24, 82, 86, 91; 220/284

[56] References Cited

U.S. PATENT DOCUMENTS

| | | | |
|---|---|---|---|
| 817,100 | 4/1906 | Bergman | 220/284 |
| 3,143,207 | 8/1964 | Wagner | 206/534 |
| 3,557,747 | 1/1971 | Rigney | 206/533 |
| 3,604,559 | 9/1971 | McCall | 206/533 |
| 3,651,927 | 3/1972 | Richardson et al. | 206/534 |
| 3,743,085 | 7/1973 | Richert | 206/533 |
| 3,895,737 | 7/1975 | Phillips | 206/807 |
| 4,069,942 | 1/1978 | Marshall et al. | 206/538 |
| 4,078,661 | 3/1978 | Thomas | 206/533 |
| 4,124,143 | 11/1978 | Thomas | 221/82 |
| 4,164,301 | 8/1979 | Thayer | 221/91 |
| 4,646,936 | 3/1987 | Frazier et al. | 221/86 |

FOREIGN PATENT DOCUMENTS

| | | | |
|---|---|---|---|
| 2133091 | 7/1971 | Germany | 206/538 |

*Primary Examiner*—David T. Fidei
*Attorney, Agent, or Firm*—Joseph F. Shirtz

[57] ABSTRACT

A pill dispenser is provided for dispensing a series of different pills over a prescribed period. The dispenser disclosed is provided with a calendar that can be pre-set to begin the regimen on whatever day is selected. The apparatus of the present invention comprises a cover, calendar and base which interlock to form a dispenser. The calendar is adjustable by applying a deliberate force using a coin or other tool. After the calendar is set to the correspond the initial day to the initial dose, subsequent doses are dispensed by rotating the cover. The calendar and the cover preferably rotate in opposite directions to minimize the possibility of mis-setting the dispenser. In addition, methods of dispensing a series of different pills over a prescribed period and methods of assembling the dispenser of the present invention are also disclosed.

16 Claims, 3 Drawing Sheets

PILL DISPENSER

This is a continuation of application Ser. No. 856,784, filed Mar. 24, 1992, now abandoned, which is a division of Ser. No. 644,406, filed Jan. 22, 1991, now U.S. Pat. No. 5,154,296, which is a continuation of Ser. No. 357,579, filed on May 26, 1989 now abandoned.

The present invention primarily relates to apparatus for containing and dispensing pills which must be administered at prescribed times or days. More particularly, the present invention provides a pill dispenser which is adjustable to account for the particular day or time on which a pill dispensing cycle begins. Methods of assembling such a device and methods of using such a device are also disclosed.

BACKGROUND OF THE INVENTION

For a variety of reasons, it is sometimes necessary to administer medicine in the form of pills or capsules for prescribed time periods or during certain intervals. One example of a product having this type of regimen requirement is an oral contraceptive. Presently, oral contraceptives are dispensed using a package known as a "dialpack", which has a calendar ring as a integral part of the base component. Dispensers such as dialpacks are necessary to ensure that the user takes a pill each day and is able to verify the pills are being taken according to schedule. The relationship between the calendar and the dispenser is fixed, and cannot be rotated or otherwise adjusted. Therefore, using currently available dialpack designs, the user is obligated to begin a regimen on a Sunday, or whatever day is designated on the package to correspond to a first dosage.

Recent advances in oral contraceptives have led to an improved version which more precisely relates the dosage administered to a particular point within the menstrual cycle; this is known as a phasic regimen. The specific day for taking the first pill is determined by the onset of the menstrual cycle. Therefore, the particular day upon which a medication cycle will commence does not necessarily correspond to the fixed day mandated by the current dialpack—it might occur on any day of the week, and will vary from month to month. It is essential, however, that during a phasic regimen all pills be dispensed in their correct sequence, since the amount of active ingredients in each pill varies and corresponds to a particular day within the menstrual cycle. It is therefore desirable to provide a pill dispenser which allows the user to pre-select the start day.

SUMMARY OF THE INVENTION

Accordingly, it has now been found that a pill dispenser which allows the user to pre-position a calendar to any day of the week before starting a regimen with no interference to the sequence of pills in the dispenser is provided by placing an adjustable calendar mechanism within a pill dispenser. The mechanism comprises a calendar ring which moves only in one direction (e.g., counterclockwise). The apparatus of the present invention requires a deliberate force to rotate and set the calendar ring, minimizing any possibility that the calendar will be altered or otherwise mis-set during normal use. However, if the user happens to make a mistake further deliberate force may be used to reset the calendar to the correct position. After the calendar is set and the first pill is dispensed, subsequent pills are dispensed by rotating a cover in the opposite direction (e.g., clockwise) which minimizes the risk of changing the calendar setting once a regimen has begun.

In a preferred embodiment, the present invention provides apparatus for dispensing a series of pills during the intervals of a prescribed period, most preferably either twenty-eight or twenty-one days, comprised of three interlocking components. First, a cylindrical cover having a top surface, an inner rim and an outer rim which has an external surface and a lower edge is provided. The cover further has a slot for dispensing one of said pills at a time, preferably the cover has a removable portion for substantially enclosing the slot prior to initial use. The cover is preferably formed of a substantially transparent material.

A second component, a calendar ring for indicating a time period, is comprised of a first disc shaped portion, which has an outer edge, and a second disc shaped portion which has a surface with a plurality of time period indicators inscribed thereon. Most preferably, the means for indicating a time period indicates the days of the week. In a most preferred embodiment, the calendar has a flange connecting the first and second disc shaped portions.

Finally, a cylindrical base having an outer wall and an inner wall, and with a plurality of compartments disposed between the walls for holding pills in a separated and orderly fashion is provided. The cover coacts with the base to enclose and separate each of the pills, and is adjustable relative to the base means. The calendar is also adjustable relative to said base means. The interaction of these three components allows the calendar to be adjusted to correlate the beginning of the prescribed period to the correct day upon which the pill corresponding the first dose of the regimen is taken. Thereafter, each successive pill is dispensed for each interval of the period by advancing the cover relative to the base.

In a most preferred embodiment, the cover has an interlocking portion comprised of a plurality of downwardly depending extensions affixed to the cover. The calendar has an edge which cooperates with the cover and at least one interlocking projection extends from the calendar. Thus, the base and calendar may be interlocked to create a subassembly. The base also has means for accepting an interlocking element, which most preferably is the element extending from the calendar. The means for accepting an interlocking element on the base is preferably disposed upon its inner wall.

In accordance with another aspect of the present invention, two sets of ratchet mechanisms are provided to allow rotation only in specified directions. The cover has a cover ratchet pawl for permitting rotation in one direction extending from the outer edge of the cover which cooperates with the cover ratchet teeth preferably disposed on the outer rim of the base. In a similar manner, the calendar is provided with a ratchet pawl, preferably disposed upon its outer edge claim, which cooperates with a set of ratchet teeth disposed on the inner rim of the base, allowing rotation in the opposite direction of the cover. To assure accurate operation, a disc shaped portion of said calendar is provided with a groove for accommodating means for imparting a rotational force, such as a coin. This feature prevents the calendar from being set by hand rotation alone. The cover, however, may be advanced using the hand and is preferably provided with means for enhancing a grasp disposed on said outer rim surface, such as serrations.

The present invention also provides methods of assembling apparatus for dispensing a series of pills during the intervals of a prescribed period. A base and a calendar for indicating a time period are provided which have interlocking portions. The base and calendar are then placed into engagement so that said base and calendar are joined by the interlocking portions, thereby creating a first subassembly. Next, the first sub-assembly is pressed into engagement with a cover so that the subassembly and cover are joined by interlocking portions, thereby creating apparatus for dispensing a series of pills. The cover of the dispenser so assembled is rotatable in a first direction relative to the base and the calendar is rotatable in an opposite direction relative to the base.

Methods of dispensing a series of pills during the intervals of a prescribed period are also disclosed. A patient is provided with a dispenser having an adjustable calendar and means for dispensing a single pill. The user first aligns the calendar with the day upon which the first pill is to be taken by adjusting the calendar, and dispenses the first pill. During subsequent intervals, the user aligns the portion of the cover having the means for dispensing a single pill with the corresponding portion of the calendar to dispense each pill during the corresponding interval of the prescribed period.

DETAILED DESCRIPTION OF THE PREFERRED EMBODIMENT

Figure 1:
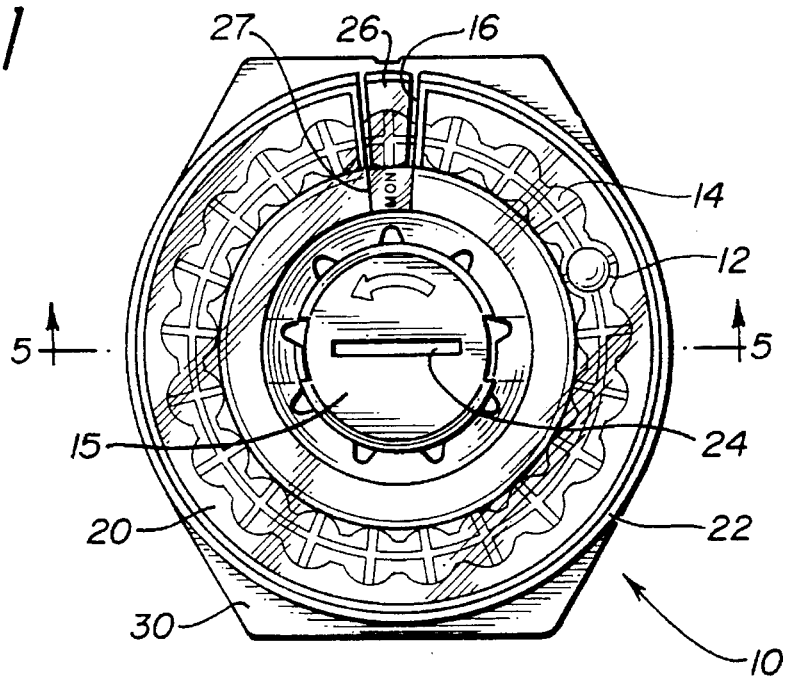
FIG. 1 is a plan view of the dispenser of the present invention.

Referring to FIG. 1, there is shown generally as 10 a plan view of a preferred embodiment of the pill dispenser of the present invention. A base portion 30 is provided which has a plurality of compartments 14 formed in order to separate and individually contain each pill, one of which is shown as 12. The pills 12 are thus kept in individual compartments 14; this arrangement both facilitates single dispensing and provides verification that the recommended pattern of use is being followed. In a most preferred embodiment, the compartments 14 are arrayed in a circular fashion, thereby forming an interior space between an inner and an outer wall of the base 30.

In order to completely constrain each pill 12, a cover 20 is provided. The cover 20 and the base 30 coact to completely surround the pill 12 to retain it in its compartment 14 regardless of the orientation of the dispenser 10. The cover 20 is further provided with a slot 16 through which a single pill will be dispensed. When the slot 16 and one of the compartments 14 are aligned, the pill 12 residing in that compartment 14 is dispensed. Prior to initial use, the slot 16 is preferably provided with a cover 26, which is removed immediately prior to the administering of the first pill. Since the compartments 14 containing the pills 12 are arrayed in a circular fashion, it can be seen that an indexed rotation of the cover 20 relative to the base 30 will position a single pill beneath the slot 16 each time the cover is advanced. The cover 20 is preferably formed of a substantially transparent material in order to allow the status of the pills in the dispenser 10 to be inspected.

As seen in FIG. 1, the slot 16 extends radially inward and is of sufficient width to allow a portion of the inner calendar ring 15 to be viewed by the user. In a most preferred embodiment, the inner calendar ring 15 will be inscribed to reflect the days of the week. When used for oral contraceptives, the number of compartments 14 and thus the number of days inscribed thereon may be for example, either twenty-eight or twenty-one. It is understood, however, that times of the day, numbers of weeks, other measures of time, or a series of numerals or letters may be substituted for the days of the week inscription, depending upon the ultimate use of the dispenser 10. Previously, the relationship between the calendar 15 and the base 30 was fixed, however, as provided by one aspect of the present invention, the calendar 15 ring illustrated may be rotated relative to the base 30 in an indexed manner, as shown by the arrow in the center of FIG. 1. This feature allow the user to set the dispenser to the day upon which the regimen begins, rather than begin a regimen on the particular day fixed by the current dialpack design.

In use, a patient first determines the day upon which the medication regimen is to begin. In the case of those oral contraceptives which follow a phasic regimen, this would be a pre-determined and prescribed number of days after the commencement of the menstrual cycle. Therefore, in accordance with one of the novel aspects of the present invention, the patient merely inserts a coin or other appropriate means of imparting force into the groove 24 provided and rotates the calendar 15 until the day of the week on which the regimen begins is visible in the slot 16. In a most preferred embodiment, the calendar 15 and the base co-act, thereby allowing the calendar ring 15 to be rotated in an indexed manner in only one direction, which may be shown by an arrow in the vicinity of the groove 24 if so desired. Most preferably, a ratchet mechanism, described below, provides this feature, however, one of ordinary skill will realize that there are numerous ways to integrate the calendar, base, and cover in order to allow the calendar to be adjusted independently of the base and cover, and to limit that adjustability to only one direction. In the embodiment illustrated, the calendar 15 may only be rotated in the counterclockwise direction.

After the correct day of the week or other indication has been aligned with the slot 16, the slot cover 26 is removed. Unless an error is made by the user, the first pill of the regimen was placed beneath the slot 16 during the manufacturing process and the cover 20 should not have been heretofore moved relative to this position. Therefore, upon removing the cover 26, the first dose is dispensed.

After a first dosage has been dispensed, the regimen will proceed until the dispenser is emptied. The cover 20 is rotated relative to the base to dispense the next dose. The user advances the cover 20 as shown by the arrow in FIG. 1; the cover 20 may be rotated in only one direction. The direction of rotation, preferably clockwise, is opposite the direction of rotation between the calendar 15 and the base 30. This feature minimizes the risk that the user will mis-set the dispenser. As described below, the cover 20 is also provided with a ratchet mechanism which permits rotation in a single direction. The user is thus prevented form turning the cover "backwards" and thereby obtaining an incorrect dose for a given day. The ratchet mechanism between the cover 20 relative to the base 30, forces the user to proceed along the prescribed regimen in an orderly and precise fashion, the dose for each day of the week clearly corresponding to the inscription visible in the slot 16.

Figure 2:
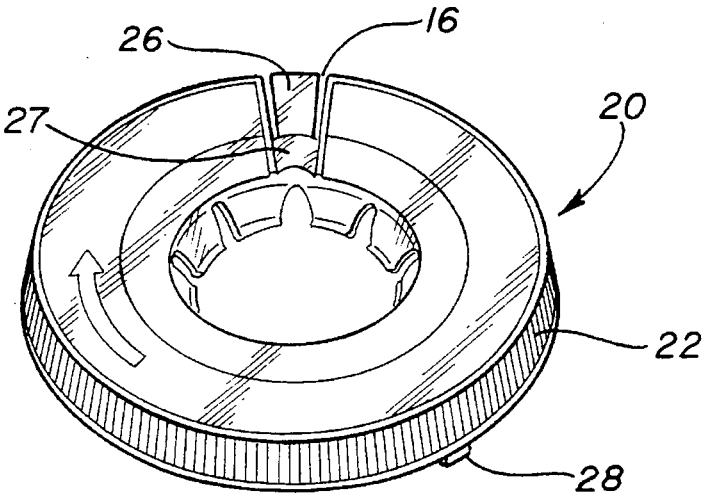
FIG. 2 is perspective view of the cover of the dispenser of the present invention.
Figure 3:
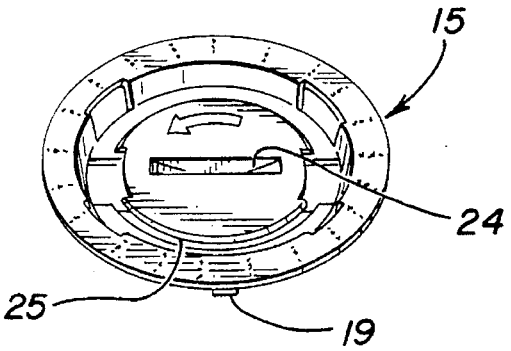
FIG. 3 is perspective view of the calendar indicator of the dispenser of the present invention.
Figure 4:
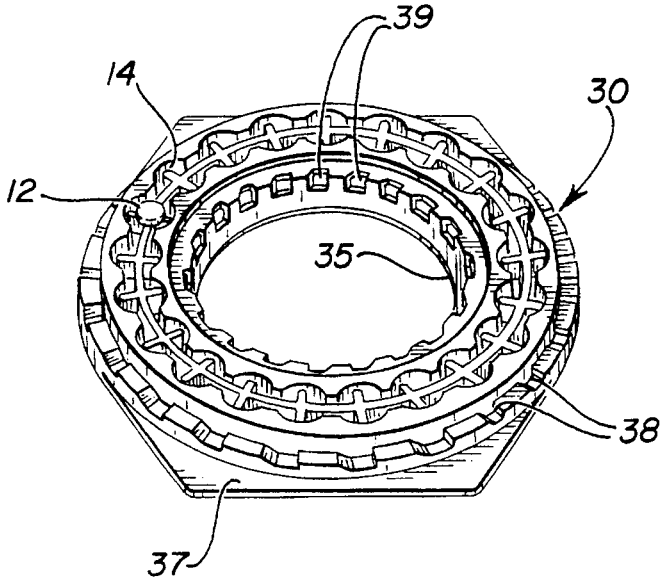
FIG. 4 is perspective view of the base of the dispenser of the present invention.

Simultaneously referring to FIGS. 2–4, one of ordinary skill will appreciate the manner in which the preferred embodiment of the dispenser of the present invention operates and is fabricated. FIGS. 2–4 illustrate the cover 20, the calendar 15 and the base 30, respectively, and are aligned to form what is substantially an exploded view of the preferred embodiment. In FIG. 2, the cover 20 is illustrated. It will be observed that the cover is preferably provided with serrations 22 or other grip-enhancing means upon the surface of its periphery, in order to aid the user in rotating the cover 20. Also visible in FIG. 2 are locking elements 23 which preferably co-act with outer edge 25 of the disc shaped central portion of the calendar 15 (shown in FIG. 3) to retain the calendar 15 in a fixed manner axially, while allowing the calendar 15 to rotate freely. The slot 16 and its cover 26 are again illustrated. A portion of the cover 20 near the proximal end of the slot cover 26 is illustrated as having a magnifier 27, preferably formed of a substantially clear material which magnifies the inscription of the calendar 15 to aid the user in reading said inscription. However, certain embodiments may be constructed without this feature. Finally, the cover ratchet pawl 28 is shown which, together with the matching cover ratchet teeth 38 preferably formed in the base 30 (shown in FIG. 4) permits the cover 20 to be rotated in a single direction only. Most preferably, the cover ratchet pawl is disposed upon the lower edge or the outer rim of the cover 20, as shown.

One of ordinary skill will realize that the cover ratchet mechanism 28,38 is designed to provide a resistive force which must be overcome by the user's hand, and therefore, the design of the cover ratchet mechanism 28,38 must account for the resilience to the cover 20 and base 30. These parameters will determine the size and shape of the ratchet teeth 38 and pawl 28, which are designed to permit rotation in only one direction without an unduly restrictive resistance, and to completely prevent rotation in an opposite direction. The cover ratchet mechanism 28,38 is preferably designed so that each advancement of the ratchet 28 along the teeth 38 moves the slot 16 to a position centered over the next dose in the regimen. Thus, the user need only move the cover one "click" to access the next dose, without aligning or otherwise observing the position of the cover relative to the base. This design adds to the convenience and utility of the dispenser and also ensure no dose is skipped.

The details of the calendar 15 are illustrated in FIG. 3. The groove 24 disposed upon the disc shaped potion of the calendar 15 which is used in conjunction with a coin or other tool to adjust the calendar, as described above, to the appropriate start day. Also more clearly visible is the outer edge 25 of the disc shaped portion, which, as explained, interlocks the cover 20 and the calendar 15 by coacting with the cover projections 23. The calendar 15 also has base interlocking projections, explained below with reference to FIG. 5, which interlock the base/calendar subassembly to the cover.

The calendar ratchet pawl 19 is shown in FIG. 3. The pawl 19 mates with the calendar ratchet teeth 39, which are preferably formed in the base 30 (shown in FIG. 4), the action of this mechanism permits the calendar 15 to be rotated in only one direction, and most preferably in a direction opposite that of the rotation of the cover 20 relative to the base 30. Further, in a most preferred embodiment, the shape of the calendar ratchet mechanism 19,39 is designed to provide a resistive force in the direction in which rotation is permitted which is relatively greater that the force required to overcome the cover ratchet mechanism 28,38 and rotate the cover 20. This feature provides further assurance against mis-alignment of the calendar 15 and the base 30. As above, the teeth 39 and pawl 19 of the calendar ratchet mechanism are preferably selected to provide an indexed rotation such that each advancement of the calendar 15 indexes the indicator exactly one day. This design creates a precise and positive aspect to the selection of the start day by the user.

FIG. 4 illustrates the base 30. As described above, the cover ratchet teeth 38 and the calendar ratchet teeth 39 are shown. As explained above, the cover teeth 38 are disposed on an outer surface of the base 30, while the calendar teeth are disposed on the inner wall of the base 30. One of ordinary skill will realize that the ratchet teeth may be oriented vertically, as illustrated, or horizontally or in any other orientation. Thus, the two sets of teeth encircle the array of pill compartments 14 in a substantially concentric manner, forming a substantially cylindrical base. Projections 39 are preferably provided which extend from the base 30 in order to facilitate handling and using the dispenser 10 of the present invention. Prior to assembly, each compartment 14 will have a pill 12 inserted therein, unless the number of pills in the regimen, for whatever reason, is less than the number of compartments 14. The base 30 is most preferably molded from a plastic material.

Figure 4A:
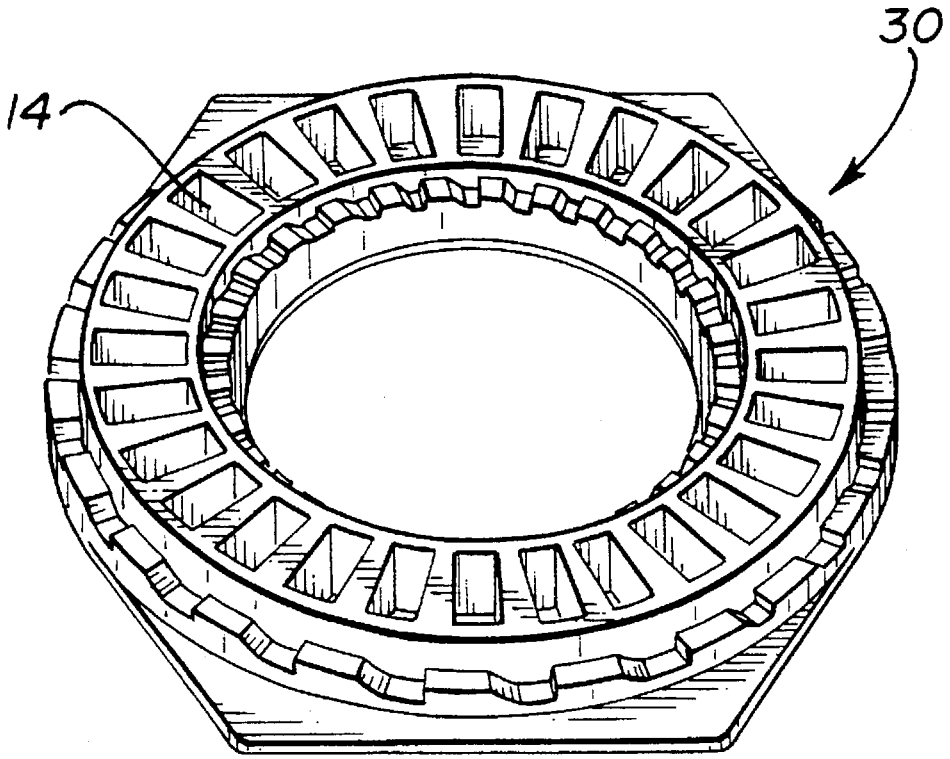
FIG. 4A is a perspective view of an alternate embodiment of the dispenser base.

An alternate embodiment of the base 30 is shown in FIG. 4A. The features and operation of this component are the same as described above with reference to FIG. 4. However, the base depicted in FIG. 4A can accommodate a larger number of pills, most preferably 28, than the embodiment of FIG. 4, since the slots 14 are more closely spaced and are designed to hold the pills on their vertical edges, rather than lying on their faces. One of ordinary skill will appreciate that other orientations and number of pills can be used without departing from the novel features of the present invention.

Figure 5:
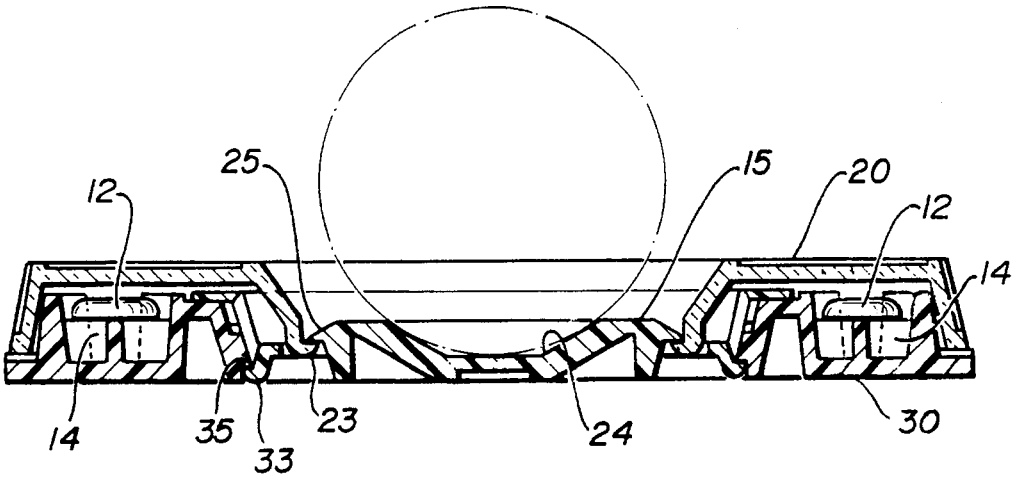
FIG. 5 is a sectional view, taken at line 5—5 in FIG. 1, of the dispenser of the present invention.

Referring to FIG. 5, a cross-sectional view taken through line 5—5 of FIG. 1 is illustrated. In this view, the interlocking action of the base locking elements 33 and the base rim 35 are clearly visible. In a like manner, the interlock between the edge 25 of the disc shaped portion of the calendar 15 and the locking elements 23 which extend from the cover 20 can also be observed. Additionally, a coin or similar object is shown in phantom as being disposed in the slot 24 in order to allow the user to rotate the calendar 15 independent of the other portions of the dispenser. Also illustrated in FIG. 5 is the placement of the pills 12 in the compartments 14 showing the manner in which they are restrained.

In order to assemble the dispenser 10 of the present invention the calendar 15 is preferably pressed into the cover 20, and is retained by the interaction of the edge 25 of the disc shaped portion of the calendar and the locking elements 23 which extend from the cover 20. Prior to this, the base 30 and calendar 15 have been pressed together. The base/calendar sub-assembly has the cover 20 placed upon it and depressed, thereby causing the base locking elements 33 which extend from the calendar 15 to engage and hold the base rim 35, thus providing a completed assembly of interlocking parts. The preferred embodiment of the present invention therefore provides a novel and simplified assembly process whereby three components are interlocked using only integral or affixed projections and cooperating portions. A dispenser assembled in this manner is securely held together, yet is designed to permit the calendar 15 to be rotated independent of the cover 20 and base 30. Similarly, the rotation of the cover 20 relative to the base 30 does not affect the position of the adjustable calendar 15, since the directions of rotation are opposite and the calendar 15 requires relatively greater force to be moved although the existence of such a relatively greater force is not critical to the function of the present invention.

The present invention further provides a dispenser which is easy for the user to operate and which can be manufactured with relatively little impact on the tooling or other costs associated with manufacturing currently available designs. Although a preferred embodiment of the present invention has been described with particularity, one of ordinary skill will realize that other arrangements and embodiments are possible, which are still within the spirit of the present invention. For example, other means of locking the component parts together or the use of additional components to provide a similar function will be apparent. Accordingly, reference should be made to the appended claims in order to fully ascertain the scope of the present invention.

What is claimed is:

1. Apparatus for dispensing a series of pills during the intervals of a prescribed period, comprising:

(a) A substantially cylindrical cover means having a top surface, an inner rim and an outer rim, said outer rim having an external surface and a lower edge;

(b) calendar means for indicating a time period, comprising a substantially disc shaped portion having a diametrically disposed groove on a surface thereof, said surface having a plurality of means for indicating a time period inscribed thereon, said calendar means having means for positively registering said calendar means in incremental positions; and (c) base means comprising a plurality of radially disposed and substantially circularly arranged, compartments for holding a plurality of pills in a separated and orderly fashion;

(d) said cover means, calendar means, and base means being substantially concentric and mutually rotatable, said calendar means being rotatable relative to said base means through application of rotational force to such grove, whereby said cover coacts with said base to enclose and separate each of said pills, and said calendar means is adjustable relative said base by insertion of separate hand held means into the groove to correlate the beginning of the prescribed period to that pill corresponding to the initial dosage and positively hold the calendar means registered in that position, thereby minimizing any possibility that the calendar means will be altered or otherwise mis-set during normal use, while thereafter each prescribed pill is dispensed during the correct interval by manually rotating said cover relative to said base.

2. The apparatus of claim 1, wherein said cover further comprises at least one interlocking portion.

3. The apparatus of claim 1, wherein said cover further comprises cover ratchet means for permitting rotation in one direction.

4. The apparatus of claim 3, wherein said cover ratchet means comprises a cover ratchet pawl extending from said lower edge of said outer rim.

5. The apparatus of claim 1, wherein said said cover further comprises means for dispensing one of said pills.

6. The apparatus of claim 5, wherein said means for dispensing is comprised of a slot.

7. The apparatus of claim 1, wherein said means for indicating a time period indicate the days of the week.

8. The apparatus of claim 1, wherein said calendar means further comprises a flange connecting said first and said second substantially disc shaped portions.

9. The apparatus of claim 1, wherein said calendar further comprises at least one interlocking projection extending therefrom.

10. The apparatus of claim 1 wherein said base further comprises a plurality of cover ratchet teeth.

11. The apparatus of claim 10, wherein said cover ratchet teeth are disposed upon said outer wall of said base.

12. The apparatus of claim 1, wherein said base further comprises means for accepting an interlocking element.

13. The apparatus of claim 12, wherein said means for accepting an interlocking element is disposed upon said inner wall of said base.

14. A method of dispensing a series of pills during the intervals of a prescribed period, comprising the steps of:

(a) providing a dispenser having an adjustable cover means and an adjustable calendar means having a groove, said groove accommodating a separate hand held implement for applying a rotational force, said cover and calendar adjustable relative to a base containing the pills, positively holding said calendar means in a predetermined incremental position after adjustment, said dispenser further having means for dispensing a single pill;

(b) aligning said means for dispensing a single pill with the interval at which the first pill is to be taken by adjusting said calendar means by the insertion of a separate hand held means for applying rotational force into the groove;

(c) dispensing the first pill to be taken; and (d) during a subsequent interval, aligning said means for dispensing a single pill with the corresponding portion of said calendar means by adjusting said cover means.

15. The method of claim 14, wherein said groove is crescent shaped into said disk, thereby to accommodate a rotational force from a coin or slug.

16. The method according to claim 14 wherein said calendar means is adjustable by rotation in a direction opposite of the direction of rotation of the cover with respect to the base.

* * * * *